United States Patent [19]

Shinozawa et al.

[11] Patent Number: 4,821,548

[45] Date of Patent: Apr. 18, 1989

[54] APPARATUS FOR CHAMFERING EDGES OF A RIM ELEMENT

[75] Inventors: Yusaku Shinozawa, Tokyo; Shin Sugiura, Toyokawa, both of Japan

[73] Assignee: Topy Kogyo Kabushiki Kaisha, Tokyo, Japan

[21] Appl. No.: 92,528

[22] Filed: Sep. 3, 1987

[51] Int. Cl.[4] ..... B21H 1/10

[52] U.S. Cl. ..... 72/107; 72/110

[58] Field of Search ..... 72/107, 109, 110, 111; 29/159.1

[56] References Cited

U.S. PATENT DOCUMENTS

| | | | |
|---|---|---|---|
| 852,829 | 5/1907 | Einfeldt | 72/111 |
| 3,097,570 | 7/1963 | Mackey | 72/111 |
| 3,616,985 | 11/1971 | Koch | 72/109 |
| 3,779,060 | 12/1973 | Schröder . | |
| 3,850,017 | 11/1974 | Fencl et al. | 72/109 |

FOREIGN PATENT DOCUMENTS

| | | | |
|---|---|---|---|
| 2032306 | 2/1972 | Fed. Rep. of Germany | 72/110 |

*Primary Examiner*—Lowell A. Larson

*Attorney, Agent, or Firm*—Birch, Stewart, Kolasch & Birch

[57] ABSTRACT

An apparatus for chamfering through press forming edges of a rim element is provided upstream of a flaring machine for forming a rim shape on a disk wheel manufacture line. The apparatus includes a pair of edge rolls having vertically extending axes and having respective groove members formed therein. A wall of a rim element conveyed into the apparatus is axially squeezed between the edge rolls at the groove members thereof and the edges of the rim element is press formed. Since a rim element conveyed into the apparatus has still an axially straight extending wall, the rim element has a high rigidity in the axial direction of the rim element and therefore, an undesirable deformation does not occur in the rim element during the press forming.

9 Claims, 3 Drawing Sheets

APPARATUS FOR CHAMFERING EDGES OF A RIM ELEMENT

BACKGROUND OF THE INVENTION

1. Field of the Invention

The present invention relates to an apparatus for chamfering through press forming edges of a rim element provided on a disk wheel manufacture line.

2. Description of the Background Art

On a conventional disk wheel manufacture line for manufacturing disk wheels for a vehicle, disk wheels are manufactured in the following way. At first, a flat steel plate for a rim element is rounded by a coiling machine into a rounded plate and both circumferential end portions of the rounded plate are pressed to form flat portions so that the end portions can be butt at the flat portions. Then, the flat end portions of the rounded plate are butt and welded to form a cylindrical rim element which has a flat portion at the welded portion. The welded portion is trimmed. Then, both axial end portions of the cylindrical rim element are pressed in the axial direction thereof and are flared using a flaring machine so that a rim shape is produced including rim bead seats and flanges. In addition, the cross section of the cylindrical rim element is shaped into a true circle. After flaring, the edges of the cylindrical rim element are chamfered through press forming by imposing an axial force on the flared cylindrical rim element. Then, the rim element is welded together with a disk element to form a disk wheel. Finally, the disk wheel is painted.

The reason why the edges of the rim should be chamfered is to prevent a worker from being injured by the sharp edges during manual handling in the manufacture, to prevent the paint from peeled off the edges of the rim, and to improve an outside view of the rim portion of the disk wheel.

However, in the prior art, since chamfering of the edges of the rim element through press forming is performed after flaring and such flared rim element has a small axial rigidity, the rim tends to be easily deformed when it receives a large axial force during press forming. The reason why the chamfering has been performed after flaring in the prior art is that the rim element to be chamfered does not have a generally true circle cross section because of its flat portion which has been thought to be inevitable for butt-welding. In addition, chamfering through press forming accompanied by rotation of the rim element can not be applied to a cylindrical element which does not have a generally true circular cross section. A chamfering through machining of the edges of the rim element having no generally true circle cross section may be possible without imposing a large axial force on the cylindrical element, but such chamfering through machining will increase cost and time of the manufacture and is not practical.

However, the inventors have found that chamfering through press forming can be performed before flaring by developing a butt welding method or an apparatus in which the end portions of a rounded plate are left rounded without providing flat portions therein and are butt welded. For example, a circumferential force may be imposed on the end portions of the rounded plate. The apparatus in accordance with the present invention is applied for chamfering the edges of the rim element having a generally true circular cross section.

SUMMARY OF THE INVENTION

An object of the present invention is to chamfer edges of a rim element through press forming without causing a large deformation in the rim element.

The above object is achieved, according to the present invention, by an apparatus for chamfering through press forming edges of a rim element, provided upstream of a flaring machine on a disk wheel manufacture line. In the arrangement, a rim element includes an axially straight extending wall when the rim element is conveyed into the apparatus, and the rim element is conveyed into the apparatus with an axis of the rim element maintained horizontal.

The apparatus includes a member for supporting thereon the rim element rotatably around the axis of the rim element, thereby defining a rim element chamfering position in a vertical direction.

A pair of edge rolls are provided on both sides of the rim element chamfering position in an axial direction of a rim element when the rim element is conveyed into the rim element chamfering position. The edge rolls include respective vertically extending axes and are adapted so as to rotate around the respective axes thereof. The edge rolls are formed with respective groove members opening radially outside which extend in circumferential directions of the respective edge rolls over the entire circumferences of the respective edge rolls. The groove members are formed at portions of the respective edge rolls which axially oppose a wall of a rim element when the rim element is conveyed into the rim element chamfering position.

A member is provided on both sides of the rim element chamfering position, for supporting the edge rolls rotatably around the respective axes of the edge rolls.

Another member is connected to the member for supporting the edge rolls, for driving the member for supporting the edge rolls together with the edge rolls toward or away from the rim element chamfering position in the axial direction of a rim element when the rim element is conveyed into the rim element chamfering position.

In addition, a member is connected to the edge rolls, for rotating the edge rolls around the axes of the respective edge rolls such that the pair of edge rolls rotate opposite to each other.

According to the above apparatus, since the apparatus is located upstream of a flaring machine on a disk wheel manufacture line, the rim element includes a straight extending wall and has a high axial rigidity. Therefore, when the rim element receives a large axial force during the chamfering through press forming of the edges, the rim element does not yield an desirable deformation.

BRIEF DESCRIPTION OF THE DRAWINGS

These and other objects and advantages of the present invention will become more apparent and more readily appreciated from the following detailed description of the presently preferred exemplary embodiment of the invention taken in conjunction with the accompanying drawings, of which.

DETAILED DESCRIPTION OF THE PREFERRED EMBODIMENT

Figure 1:
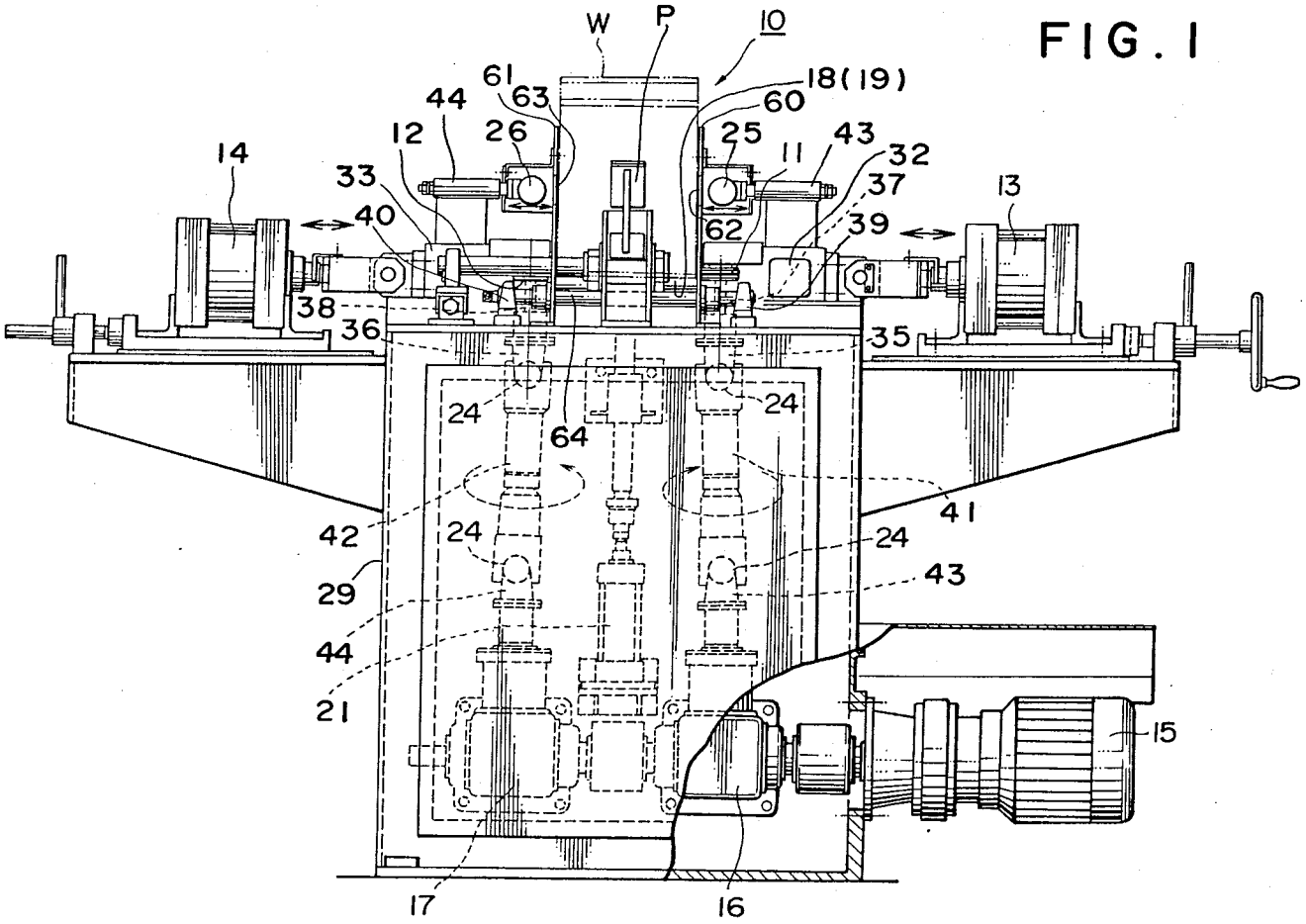
FIG. 1 is a front elevational view of a chamfering apparatus in accordance with the present invention.
Figure 2:
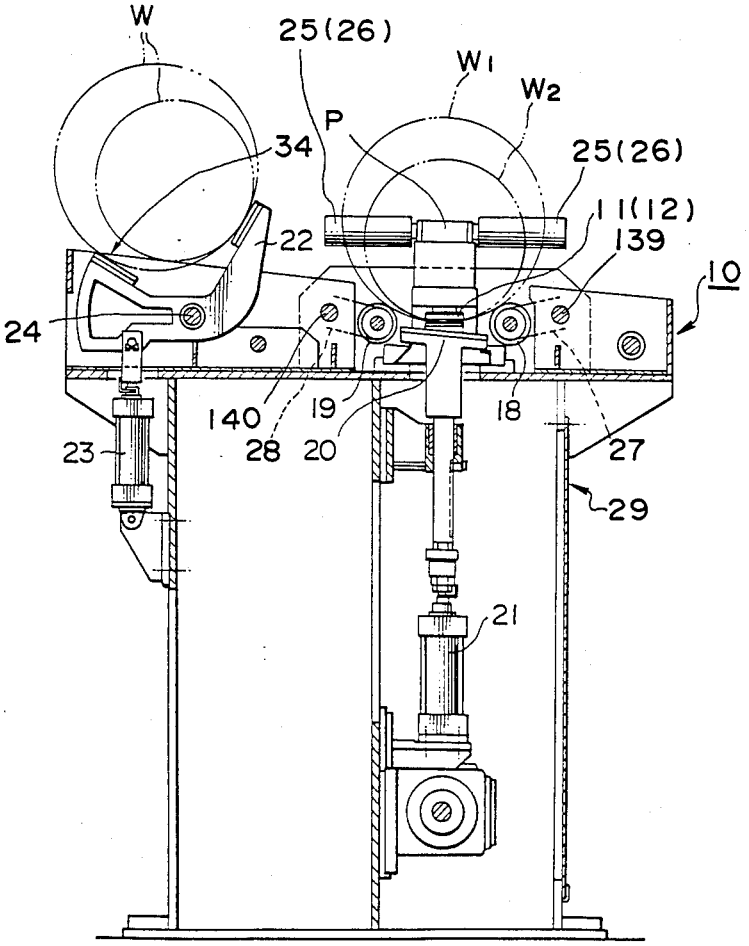
FIG. 2 is a side elevational view of the apparatus of FIG. 1.
Figure 3:
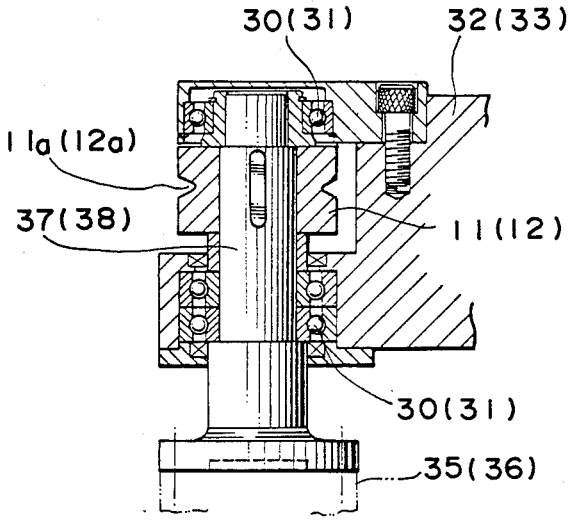
FIG. 3 is a sectional view of edge rolls and portions in the vicinity of the edge rolls used in the apparatus of FIG. 1.

FIGS. 1 and 2 illustrate an entire structure of an edge treatment apparatus in accordance with the present invention, and FIG. 3 illustrates the details of edge rolls used in the apparatus.

Figure 4:
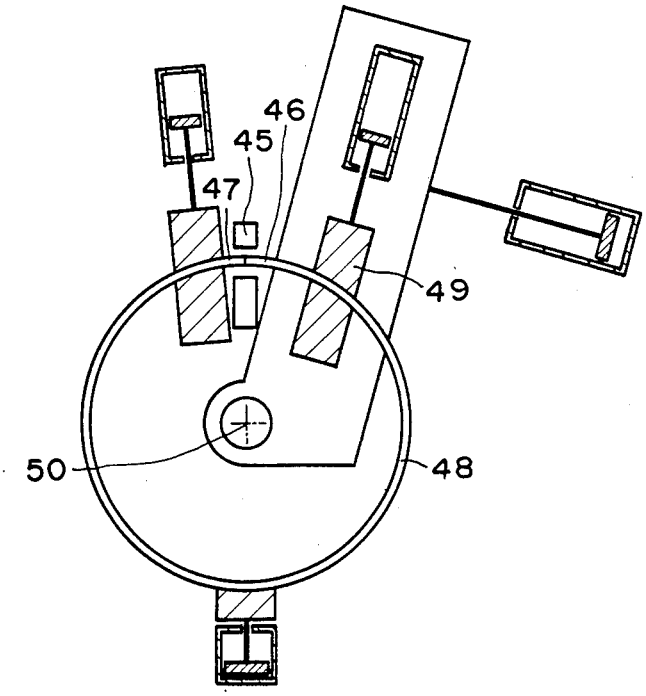
FIG. 4 is an elevational view of a welding machine provided on an upstream side of the apparatus of the present invention on a disk wheel manufacture line.

In the drawings, a rim element W is provided to be chamfered. An apparatus 10 for chamfering edges of the rim element W is located upstream of a flaring machine (not shown) on a disk wheel manufacture line. The apparatus 10 is also located downstream of a coiling machine (not shown) for rounding a flat steel plate, a welding machine for welding the butt end portions of the rounded plate to form a cylindrical rim element, and a trimming machine (not shown) for trimming the welded portion of the cylindrical rim element. For the welding machine, a welding machine as shown in FIG. 4 may be used. In the welding machine 45 of FIG. 4, the end portions 46 and 47 of the rounded plate 48 which are left rounded without providing flat portions are circumferentially butt under imposing a generally circumferential force on the rounded plate 48 and are welded. A clamp 49 can rotate around an axis 50 of the rounded plate 48. Due to this arrangement of the apparatus 10, the rim element W has still an axially straight extending wall and a generally true circular cross section with a constant diameter over the entire axial length thereof, when the rim element W is conveyed into the apparatus 10. This means that, in the present invention, such a special means for forming flat portions at the end portions of the rounded plate is not necessary to be provided. The rim element W is conveyed into the apparatus 10 with its axis maintained in the horizontal direction.

The apparatus 10 for chamfering edges of the rim element W through press forming comprises: (a) means 18 and 19 for rotatably supporting thereon a rim element W conveyed into the apparatus 10 rotatably around an axis of the rim element W, thereby defining a rim element chamfering position P in a vertical direction, (b) a pair of edge rolls 11 and 12, provided on both sides of the rim element chamfering position P in an axial direction of a rim element W when the rim element W is conveyed to the rim element chamfering position P, having vertically extending axes and having circumferentially extending groove means 11*a* and 12*a* formed therein at portions axially opposing a wall of a rim element W when the rim element W is positioned at the rim element chamfering position P, (c) means 30, 31, 32 and 33, provided on both sides of the rim element chamfering position P, for rotatably supporting the edge rolls 11 and 12, (d) means 13 and 14, connected to the means 32 and 33 for rotatably supporting the edge rolls, for driving the means 30, 31, 32 and 33 for rotatably supporting the edge rolls together with the edge rolls 11 and 12 toward or away from the rim element chamfering position P, and (e) means 15, 16 and 17, connected to the edge rolls 11 and 12, for rotating the edge rolls 11 and 12 such that the edge rolls 11 and 12 rotate opposite to each other around their respective axes.

The means 18 and 19 for supporting a rim element W thereon comprises a pair of free rollers 18 and 19 capable of rotating freely around the respective axes thereof which are spaced from each other and which extend in parallel with each other. The axes of the free rollers 18 and 19 extend parallel to the axis of the rim element W conveyed into the apparatus 10. When a rim element W is conveyed onto the free rollers 18 and 19 and a vertical position of the rim element W is determined by the free rollers 18 and 19. In this way, the free rollers 18 and 19 define the rim element chamfering position P in a vertical direction. The free rollers 18 and 19 are supported by arms 27 and 28 which are pivotally connected to a frame 29 via pivot shafts 139 and 140 such that a vertical position of the free rollers 18 and 19 can be adjusted through adjusting inclination of the arms 27 and 28 corresponding to a variance in diameters of rim element W conveyed into the apparatus 10. In FIGS. 1 and 2, two two-dotted lines $W_1$ and $W_2$ illustrate two rim elements with a large diameter and a small diameter, respectively.

Edge rolls 11 and 12 have groove means 11*a* and 12*a*, respectively, which are formed in the radially outer portions of the respective edge rolls 11 and 12 so as to open radially outward. Preferably, the groove means 11*a* and 12*a* have the shape of a laterally fallen V letter. The groove means 11*a* and 12*a* extend over the entire circumferences of the respective edge rolls 11 and 12. The edge rolls 11 and 12 are adapted in the apparatus 10 such that the groove means 11*a* and 12*a* (shown in FIG. 3) formed therein axially oppose a lowermost portion of a wall of a rim element W when the rim element W is positioned on the free rollers 18 and 19. The reason why the groove means 11*a* and 12*a* should be opposed to the lowermost portion of the rim element W is that positional correspondence in a vertical direction between the groove means 11*a* and 12*a* and a wall of a rim element W is easily obtained when a diameter of a rim element W conveyed into the apparatus 10 is varied.

The means 30, 31, 32 and 33 for rotatably supporting the edge rolls 11 and 12 comprise (a) a pair of blocks 32 and 33 provided on both sides of the rim element chamfering position P such that they can move toward or away from the rim element chamfering position P, and (b) bearings 30 and 31, housed in the blocks 32 and 33, for allowing rotation of the edge rolls 11 and 12 around the respective axes thereof by rotatably supporting shafts 37 and 38 of the edge rolls 11 and 12.

The means 13 and 14 for driving the means for rotatably supporting the edge rolls in the axial direction of a rim element W when the rim element W is conveyed to the rim element chamfering position P comprises a pair of cylinders 13 and 14, rods of which are connected to the movable blocks 32 and 33 of the means 30, 31, 32 and 33 for rotatably supporting the edge rolls.

The means 15, 16 and 17 for rotating the edge rolls comprises (a) an electric motor 15 having an output shaft, and (b) a pair of bevel gear means 16 and 17, connected to the output shaft of the electric motor 15 and to the edge rolls 11 and 12, for transmitting rotations of the output shaft of the electric motor 15 to the edge rolls 11 and 12 such that the pair of edge rolls 11 and 12 rotate opposite to each other around the respective axes thereof. The means for rotating the edge rolls can further include a plurality of universal joints 24 which are provided for absorbing dimensional tolerances which may exist in the torque transmitting structure including a plurality of torque transmitting shafts 35, 36, 41, 42, 43 and 44.

The apparatus 10 can further comprise means 25 and 26, provided on both sides of the rim element chamfering position P in the axial direction of a rim element W when the rim element W is conveyed to the rim element chamfering position P, for adjusting a position of a rim element W in the axial direction of the rim W element. The means 25 and 26 comprises a pair of free side rollers 25 and 26 spaced from each other which are driven by cylinders 43 and 44, respectively, in an axial direction of the rim element W when the rim element W is conveyed to the rim element chamfering position P. The apparatus 10 has side guides 60 and 61 having holes 62 and 63, respectively. The free side rollers 26 and 26 can contact the rim element W through the holes 62 and 63. The side guides 60 and 61 are spaced from each other by a distance more than the width of the rim element W and the distance between the side guides 60 and 61 can be adjusted by manually rotating an adjustment shaft 64 which is rotatably supported by bearing means 39 and 40.

The apparatus 10 can further comprise means 20 and 21 for lowering or lifting a rim element W onto or from the means 18 and 19 for rotatably supporting a rim element. The means 20 and 21 comprises (a) a support 20, provided movable in the vertical direction, having a top surface which is inclined so as to extend downward in a rim element conveyance direction, and (b) a cylinder 21, connected to the support 20, for moving the support 20 in the vertical direction. When mounting a rim element W onto the means 18 and 19 for rotatably supporting a rim element, the support 20 is lowered by the cylinder 21, while when a rim element W is ejected from the means 18 and 19, the support 20 is lifted by the cylinder 21.

The apparatus 10 can further comprise means 22 and 23, provided upstream of the rim element chamfering position P along the rim conveyance direction, for temporarily stopping conveyance of a successive rim element W which is successively conveyed into the rim element chamfering position P. The means 22 and 23 comprises (a) a stopper 22 supported by the frame 29 pivotally around a pivot axis 24 of the stopper, and (b) a cylinder 23, connected to the stopper 22 and the frame 29, for rotating the stopper 22 around the pivot axis 24 of the stopper 22. Operations of the cylinders 23, 13, 14, 43, 44 and 21 and operation of the motor 15 are electrically related with one another.

Using the above-illustrated edge chamfering apparatus 10, edges of a rim element W is chamfered in the following way.

A rim element which has been rounded and butt welded is conveyed to the rim element chamfering position P of the apparatus 10. When the rim element W is conveyed to the rim element chamfering position P, the rim element W has still an axially straight extending wall and has a generally true circular cross section. When a rim element W is staying on the free rollers 18 and 19, a successive rim element W is temporarily stopped by the stopper 22 at a waiting position. Then, a rim element W is conveyed from the waiting position onto the free rollers 18 and 19. It is a result of an inclined surface 34 and a downward motion of the support 20. A position of the rim element W is determined in the vertical direction by the free rollers 18 and 19 and in the axial direction by the free side rollers 25 and 26. In this state the rim element W is rotatable around the axis of the rim element W.

Then, the cylinders 13 and 14 are operated so as to drive the blocks 32 and 33 together with the edge rolls 11 and 12 toward the rim element W. Thus, the lowermost portion of the wall of the rim element W is squeezed with a large force in the axial direction of the rim element W between the groove means 11*a* and 12*a* formed in the edge rolls 11 and 12. At the same time, the motor 15 is operated so as to compulsorily rotate the edge rolls 11 and 12 via the bevel gear means 16 and 17. Rotation of the edge rolls 11 and 12 by the motor 15 and the axial compression force acting on the rim element W from the cylinders 13 and 14 chamfer through press forming the edges at the inside and outside corners of the wall of the rim element W. Since the rim element W is rotated 360° or more, the chamfering is done over the entire circumference of the rim element W.

When the chamfering of the edges of the rim element W has been performed, rotation of the edge rolls 11 and 12 by the motor 15 is stopped and the cylinders 13 and 14 drive the edge rolls 11 and 12 in the directions away from the rim element W. Then, the support 20 is lifted by the cylinder 21 and the rim element W is ejected from the edge chamfering apparatus 10 to the next station by gravity thanking to the inclined top surface of the support 20.

Then, a successive rim element W is conveyed into the rim element chamfering position P, and the above-illustrated chamfering is repeated.

According to the edge chamfering apparatus 10 in accordance with the present invention, the following effects are obtained.

First, since the edge chamfering apparatus 10 is provided upstream of a flaring machine on a disk wheel manufacture line, a rim element W still includes an axially straight extending wall and therefore, has a large rigidity in the direction of the rim element W, axial compression of the wall of the rim element W with a large force sufficient to chamfer the edges of the rim element W through press forming becomes possible without causing an undesirable deformation in the rim element W. This improves quality of chamfering to a great extent.

Second, due to the arrangement of the edge chamfering apparatus 10 in which the apparatus 10 is provided upstream of a flaring machine, it becomes unnecessary to form flat portions at the end portions of a rounded plate for butt welding. This can simplify the disk wheel manufacture line and decrease the cost of the line.

Third, since a rim element W is chamfered through press forming, the chamfering is performed with high speeds in comparison with chamfering through machining.

Fourth, since the groove means 11*a* and 12*a* formed in the edge rolls 11 and 12 comprise a groove having the shape of a substantially V-letter, the groove means 11*a* and 12*a* can absorb variances in a wall thickness of a rim element W conveyed on the disk wheel manufacture line.

Fifth, since the edge rolls 11 and 12 are provided at the position corresponding to the lowermost portion of a wall of a rim element W, no adjustment of a vertical position of the edge rolls 11 is substantially needed when a diameter of the rim element W conveyed on the line is varied.

Finally, due to the structure of the apparatus 10 according to the present invention, a positioning mechanism and a chamfering mechanism thereof become simple in comparison with those of a prior art chamfering apparatus.

Although only one embodiment of the present invention has been described in detail above, those skilled in the art will readily appreciate that many modifications and alterations are possible in the exemplary embodiment without departing from the novel teachings and advantages of the invention. Accordingly, all such modifications and alterations are intended to be included within the scope of the present invention as defined in the following claims.

What is claimed is:

1. An apparatus for chamfering through press forming edges of a rim element for a wheel of a vehicle, wherein the chamfering apparatus is located upstream of a flaring machine on a wheel rim manufacturing line so that rim element has an axially straight extending wall and a generally circular cross section when the rim element is conveyed into the apparatus, said apparatus comprising:

means for supporting thereon a rim element conveyed into the apparatus rotatively around an axis of the rim element, said rim element supporting means including two freely rotatable rollers arranged to extend in a horizontal direction and spaced from and parallel to each other so that a rim element conveyed toward the apparatus with an axis of the rim element maintained in a horizontal direction is supplied into the apparatus maintaining the direction of the axis of the rim element in the horizontal direction and said two rollers defining a rim element chamfering position in a vertical direction above said two rollers;

a pair of edge rolls provided on both sides of said rim element chamfering position in an axial direction of a rim element conveyed to said rim element chamfering position and provided between said two rollers of said rim element supporting means, said edge rolls having respective vertically extending axes and being adapted so as to rotate around the respective axes thereof, said edge rolls being formed with circumferentially extending groove means formed therein at portions axially opposing a lowermost portion of a wall of a rim element when the rim element is positioned at said rim element chamfering position;

edge roll supporting means, provided on both sides of said rim element chamfering position in an axial direction of a rim element when the rim element is conveyed to said rim element chamfering position, for supporting said edge rolls rotatively around the respective axes thereof, said edge rolls supporting means being arranged to be movable toward and away from said rim element chamfering position in the horizontal direction and in the axial direction of the rim element conveyed to said rim element chamfering position;

drive means, connected to said edge roll supporting means, for driving said edge roll supporting means toward and away from said rim element chamfering position in an axial direction of a rim element when the rim element is conveyed to said rim element chamfering position, said driving means driving said edge roll supporting means toward said chamfering position so that an axially straight extending wall of a rim element conveyed to said rim element chamfering position is axially compressed, at one portion of the rim element in a circumferential direction of the rim element, between said pair of edge rolls to be chamfered at said circumferentially one portion of the rim element through press forming while maintaining a high rigidity in the axial direction of the rim element due to the straight extension of the wall of the rim element; and means, coupled to said edge rolls, for rotating said edge rolls urged toward said rim element chamfering position by said edge roll driving means such that said edge rolls rotate opposite to each other around their respective axes to thereby rotate a rim element around an axis of the rim element and to chamfer entire peripherals of end portions of the axially straight extending wall of the rim element.

2. The apparatus according to claim 1, wherein said groove means have a cross section of the shape of a laterally projecting V-letter.

3. The apparatus according to claim 1, wherein said means for rotatably supporting the edge rolls comprises:

a pair of blocks provided on both sides of said rim element chamfering position such that said blocks can move toward or away from said rim element chamfering position; and bearings, housed in said blocks, for rotatably supporting said edge rolls.

4. The apparatus according to claim 3, wherein said means for driving the means for rotatably supporting the edge rolls comprises a pair of cylinders and includes rods which are connected to said blocks.

5. The apparatus according to claim 1, wherein said means for rotating the edge rolls comprises:

an electric motor having an output shaft; and a pair of bevel gear means, provided in a torque transmitting means which is connected to an output shaft of said electric motor and to said edge rolls, for transmitting rotations of said output shaft of said electric motor to said edge rolls such that said edge rolls rotate opposite to each other around the respective axes thereof.

6. The apparatus according to claim 1, further comprising means, provided on both sides of said rim element chamfering position in an axial direction of a rim element when the rim element is conveyed into said rim element chamfering position, for adjusting a position of a rim element in an axial direction of the rim element when the rim element is conveyed to said rim element chamfering position, thereby defining said rim element chamfering position in the axial direction of the rim element chamfering position.

7. The apparatus according to claim 1, further comprising means, provided upstream of said rim element chamfering position, for temporarily stopping conveyance of a successive rim element which is successively conveyed to said rim element chamfering position.

8. The apparatus according to claim 7, wherein said means for temporarily stopping conveyance of a successive rim element comprises:

a stopper supported pivotally around a pivot axis of said stopper; and a cylinder, connected to said stopper, for rotating said stopper around said pivot axis of said stopper.

9. An apparatus for chamfering through press forming edges of a rim element for a wheel of a vehicle, wherein the chamfering apparatus is located upstream of a flaring machine on a wheel rim manufacturing line so that a rim element has an axially straight extending wall and a generally circular cross section when the rim element is conveyed into the apparatus, said apparatus comprising:

means for supporting thereon a rim element conveyed into the apparatus rotatively around an axis of the rim element, said rim element supporting means including two freely rotatable rollers arranged to extend in a horizontal direction and spaced from and parallel to each other so that a rim element conveyed toward the apparatus with an axis of the rim element maintained in a horizontal direction is supplied into the apparatus maintaining the direction of the axis of the rim element in the horizontal direction and said two rollers defining a rim element chamfering position in a vertical direction above said two rollers;

a pair of edge rolls provided on both sides of said rim element chamfering position in an axial direction of a rim element conveyed to said rim element chamfering position and provided between said two rollers of said rim element supporting means, said edge rolls having respective vertically extending axes and being adapted so as to rotate around the respective axes thereof, said edge rolls being formed with circumferentially extending groove means formed therein at portions axially opposing a lowermost portion of a wall of a rim element when the rim element is positioned at said rim element chamfering position;

edge roll supporting means, provided on both sides of said rim element chamfering position in an axial direction of a rim element when the rim element is conveyed to said rim element chamfering position, for supporting said edge rolls rotatively around the respective axes thereof, said edge roll supporting means being arranged to be movable toward and away from said rim element chamfering position in the horizontal direction and in the axial direction of the rim element conveyed to said rim element chamfering position;

drive means, connected to said edge roll supporting means, for driving said edge roll supporting means toward and away from said rim element chamfering position in an axial direction of a rim element when the rim element is conveyed to said rim element chamfering position, said driving means driving said edge roll supporting means toward said chamfering position so that an axially straight extending wall of a rim element conveyed to said rim element chamfering position is axially compressed, at one portion of the rim element in a circumferential direction of the rim element, between said pair of edge rolls to be chamfered at said circumferentially one portion of the rim element through press forming while maintaining a high rigidity in the axial direction of the rim element due to the straight extension of the wall of the rim element;

means, coupled to said edge rolls, for rotating said edge rolls urged toward said rim element chamfering position by said edge roll driving means such that said edge rolls rotate opposite to each other around their respective axes to thereby rotate a rim element around an axis of the rim element and to chamfer entire peripherals of end portions of the axially straight extending wall of the rim element; and means for lowering and lifting a rim element onto and from said rim element supporting means, said lowering and lifting means including a support movable in a vertical direction and having an inclined top surface extending downward in a rim element conveyance direction, and a cylinder coupled to said support so as to move said support in the vertical direction.

* * * * *